US009334074B2

(12) United States Patent
Spix

(10) Patent No.: US 9,334,074 B2
(45) Date of Patent: May 10, 2016

(54) METHOD AND MACHINE FOR CUTTING THERMOFORMED PACKAGES

(75) Inventor: Guido Spix, Ulm (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 802 days.

(21) Appl. No.: 13/560,518

(22) Filed: Jul. 27, 2012

(65) Prior Publication Data

US 2013/0025243 A1 Jan. 31, 2013

(30) Foreign Application Priority Data

Jul. 29, 2011 (DE) ..... 10 2011 108 939

(51) Int. Cl.

| | |
|---|---|
| ***B65B 57/02*** | (2006.01) |
| ***B65B 61/06*** | (2006.01) |
| ***B65B 65/00*** | (2006.01) |
| ***B65B 9/04*** | (2006.01) |
| *B65B 41/18* | (2006.01) |
| *B65B 47/00* | (2006.01) |

(52) U.S. Cl.

CPC . *B65B 57/02* (2013.01); *B65B 9/04* (2013.01); *B65B 61/06* (2013.01); *B65B 61/065* (2013.01); *B65B 65/006* (2013.01); *B65B 41/18* (2013.01); *B65B 47/00* (2013.01); *Y10T 83/04* (2015.04)

(58) Field of Classification Search

CPC .... B65B 57/02; B65B 7/2878; B65B 65/006; B65B 9/04–9/045; B65B 41/18; B65B 47/00–47/10; B65B 61/04–61/10; B65B 61/065; Y10T 83/538; Y10T 83/04

USPC ..... 53/453, 559, 478, 329.2–329.5, 51, 52, 53/64, 67, 75; 83/33, 34, 286, 358, 359, 83/360, 368, 370

See application file for complete search history.

(56) References Cited

U.S. PATENT DOCUMENTS

| | | | | |
|---|---|---|---|---|
| 2,599,430 | A | 6/1952 | Beuerman | |
| 4,349,997 | A * | 9/1982 | Hayasaka et al. | B65B 41/18 156/351 |
| 4,819,406 | A * | 4/1989 | Redmond | B65B 9/042 53/133.1 |
| 4,849,679 | A * | 7/1989 | Taft et al. | 318/577 |
| 4,905,159 | A | 2/1990 | Loriot | |
| 5,315,807 | A * | 5/1994 | Restle et al. | 53/51 |
| 7,681,830 | B2 * | 3/2010 | Tsuruta et al. | 242/554.3 |
| 2008/0295659 | A1 * | 12/2008 | Tobin et al. | B26D 5/34 83/13 |

FOREIGN PATENT DOCUMENTS

| | | | | |
|---|---|---|---|---|
| DE | 2437127 | A1 | 2/1976 | |
| DE | 19651954 | A1 | 6/1998 | |
| DE | 202010004162 | U1 * | 7/2010 | B65B 61/025 |
| EP | 0569933 | A1 | 11/1993 | |
| EP | 1714886 | A1 | 10/2006 | |
| FR | 2411132 | A1 * | 7/1979 | B65B 9/042 |

* cited by examiner

*Primary Examiner* — Stephen F Gerrity
(74) *Attorney, Agent, or Firm* — Husch Blackwell LLP

(57) ABSTRACT

A method is provided for cutting packages out of a composite film in a thermoform packaging machine by previously detecting the position of the sealed seams and by suitably adapting the position of a cutting pattern. Additionally, a thermoform packaging machine is provided for executing the above-mentioned method.

10 Claims, 2 Drawing Sheets

METHOD AND MACHINE FOR CUTTING THERMOFORMED PACKAGES

CROSS-REFERENCE TO RELATED APPLICATION

This Application claims priority to German Application Number 102011108939.3 filed Jul. 29, 2011 to Guido Spix entitled "Method for Cutting Packaging," currently pending, the entire disclosure of which is incorporated herein by reference.

FIELD OF THE INVENTION

The invention relates to a method for cutting packages out of a composite film in a thermoform packaging machine and to a thermoform packaging machine.

BACKGROUND

Patent application EP 1 714 886 A1, which is owned by the applicant, discloses a thermoform packaging machine comprising a laser cutting unit which cuts out packages from a composite film consisting of, for example, two films that are sealed to one another. Such an intermittently operating thermoform packaging machine with high performance (packages per minute) often has an overall machine length of more than 10 meters. In such machines a forming station for forming troughs in a bottom film/foil is located at a first end of the thermoform packaging machine and a cutting station is located at a second end. Additional stations, such as an infeed station (or filling station), a sealing station, a labeling and/or printing station, are provided between said forming station and said cutting station. The packages are to be cut out along the contour of the sealed seams such that on the edge of the package a sealed seam will remain, which has a minimum width on the one hand and the most uniform possible width on the other. The bottom film is taken hold of on the side by means of two clamp chains and conveyed from a first to a second end of the thermoform packaging machine. This may lead to variations in the advance of the film, for example, due to chain elongation. Problems entailed by these variations, such as different widths of the sealed seams after the cutting of the packages, are compensated for by providing an increased width of the sealed seam, so that the smallest tolerance-conditioned width after cutting can still have the necessary minimum width. The space required for such sealed seam widths must be taken into consideration when designing the tools in the thermoform packaging machine. Sealed seams having a large width additionally require high pressures or a long sealing time for producing the sealed seams.

SUMMARY OF THE INVENTION

It is the object of the present invention to improve a thermoform packaging machine with respect to cutting such that the sealed seams only have to have the width required at the package.

The method for cutting packages out of a composite film in a thermoform packaging machine according to the present invention can comprise the following steps: sealing films in a sealing station so as to obtain packages, thus forming sealed seams, detecting the position of the sealed seams and orienting the cutting unit in conformity with the sealed seams.

Due to the detection of the position of the sealed seams upstream of or in the cutting station, the cutting unit can be oriented so precisely that the packages will be cut along the outer contour of their sealed seams, so that unnecessarily wider sealed seams are no longer required for observing a minimum width of the sealed seam along its contour.

In one embodiment, the method is so conceived that, after the sealing step, the sealed seams are detected by means of a vision system and the position of a cutting pattern is determined in a controller so as to subsequently orient the cutting unit in the conveying direction and/or transversely to the conveying direction. Determining the cutting pattern in this way provides the advantage that, even if the formats should change, which means that the forming tools and the sealing tools are exchanged, no adaptations at the cutting station will be necessary, since the sealed seams can always be determined in accordance with the film area to be cut.

A reference element may be produced in the sealing station. This reference element inevitably has a fixed spatial relationship to the sealed seams which are produced in the sealing station as well.

The reference element can be produced by means of punching or as a seal feature. The reference element may, for example, be a small punched hole, which is detected and evaluated in the cutting station later on.

According to one embodiment, the reference element is detected by means of an identification device downstream of the sealing station. This allows easy, reliable and also inexpensive measurements.

The identification device may be a vision system which is able to detect the reference element at its position in and transversely to the conveying direction.

According to one embodiment, the cutting unit is a laser cutting unit for separating the packages from one another by cutting them out of the composite film along the sealed seams, since the cutting unit itself is not moved, but it will suffice to move and deflect the scanner of the laser cutting unit in accordance with the cutting pattern ascertained. This can be done without any expenditure of time being necessary for adapting the position of the cutting unit, and setting times will be minimized.

The cutting unit can be a combination tool (i.e., cutting both longitudinally and transversely) and this combination tool can be adjusted in accordance with the cutting pattern. For example, servo drives and guide units may be provided for moving the combination tool rapidly and precisely to a new position provided for the subsequent cutting operation. The adjustment may take place in the conveying direction and/or transversely to the conveying direction.

A thermoform packaging machine according to the present invention may comprise a sealing station and a cutting unit and may be conceived such that an identification device for detecting the position of sealed seams is provided downstream of the sealing station and that, with respect to the position of the cutting pattern which can be produced by the cutting unit, the cutting unit is adapted to be oriented relative to the sealed seams. Differences in the positions of the sealed seams, which may occur due to the conveying of the film, can thus be detected and compensated for in a structurally simple manner.

The cutting unit is preferably a combination tool or a laser cutting unit so as to allow the packages to be rapidly cut out of a composite film.

In the sealing station, a reference element can be produced in a composite film by means of punching or by means of a sealing tool in an advantageous manner. This represents a simple and inexpensive solution.

According to one embodiment of the invention, the identification device is configured for detecting the position of the sealed seams by means of the reference element and for transmitting this information to a controller which, in turn, is then able to orient the cutting unit accordingly.

The identification device can be configured for detecting the contour shape of the sealed seams so as to orient the cutting unit for the intended cutting pattern and produce the cutting pattern, including its position, and transmit the information preferably to a laser cutting unit for processing. The identification device for detecting the position of sealed seams can be a vision system.

Other and further objects of the invention, together with the features of novelty appurtenant thereto, will appear in the course of the following description.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

Identical components are designated by identical reference numerals throughout the figures.

DETAILED DESCRIPTION OF THE INVENTION

Figure 1:
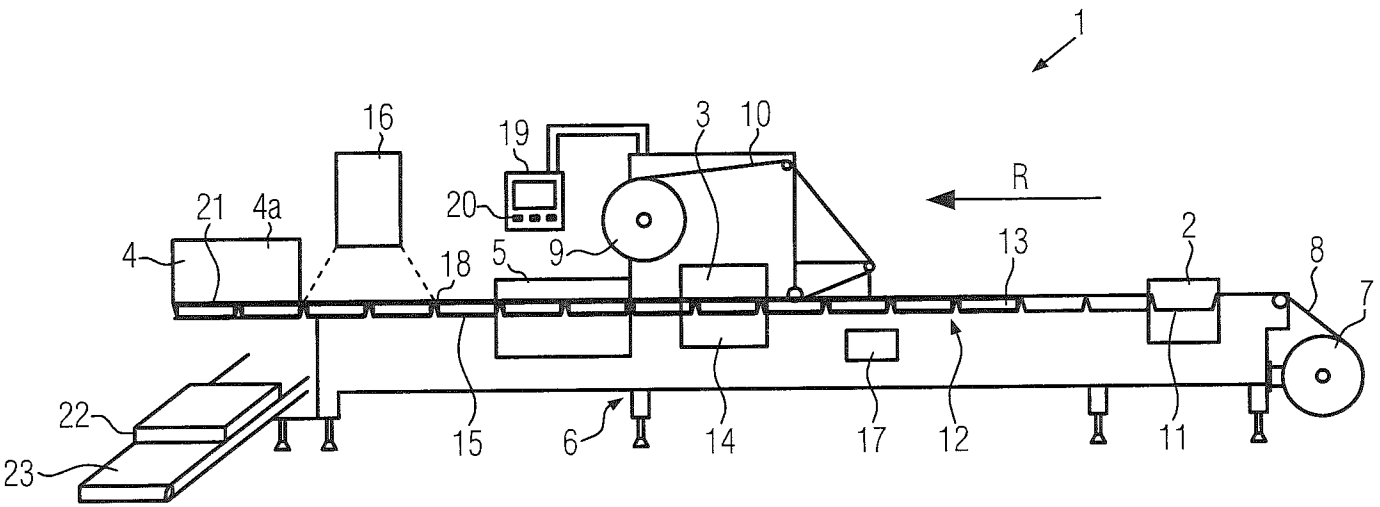
FIG. 1 is a schematic side view of a packaging machine according to the present invention in the form of a thermoform packaging machine.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a schematic view of a packaging machine 1 according to one embodiment of the present invention in the form of a thermoform packaging machine. As shown, this thermoform packaging machine 1 comprises a forming station 2, a sealing station 3, a labeller 5 and a cutting station 4, which are arranged in this order in a working direction R on a machine frame 6. On the input side, a supply roll 7 can be provided on the machine frame 6, from which a film 8 is unwound. In the area of the sealing station 3 a material storage unit 9 may be provided, from which a cover film 10 is unwound. Furthermore, the packaging machine 1 comprises a feed device 30 (see FIG. 2), which grips the film 8 and conveys it per work cycle in the working direction R.

In the embodiment shown, the forming station 2 is configured as a thermoforming station in which troughs 11 are formed in the film 8 by thermoforming. The forming station 2 can be configured such that, in the direction perpendicular to the working direction R, several troughs 11 are formed side by side. An infeed line 12, along which troughs 11 formed in the film 8 are filled with a product 13 manually or automatically, is arranged downstream of the forming station 2 in the working direction R.

The sealing station 3 can be provided with a closable chamber 14 in which the atmosphere in the packaging troughs 11 can, prior to sealing, be substituted by a substitute gas or a gas mixture, for example, by means of gas flushing. Alternatively, the packaging troughs 11 can be evacuated in the closable chamber 14.

Downstream of the sealing station 3, a labeling station 5 may be provided for applying labels to the top of the packages 15 from above and/or to the bottom of the packages 15 from below. Upstream of the cutting station 4 an identification device 16 can be provided above the packages 15, said identification device 16 being able to detect a reference element 25 or sealed seams 26 (see FIG. 2) and to transmit the resultant information to a controller 17.

At the cutting station 4, the packages 15 produced in common in one work cycle of the packaging machine 1 are separated from one another. In the course of this process, they may be simultaneously cut out of the composite film 18, which consists of the film 8 and of the cover film 10, by means of a cutting unit 4*a*, for example, a combination tool. Alternatively, a laser cuts the packages 15 out of the composite film 18, the laser being moved along the outer edge of the sealed seams 26 of the packages 15 for this purpose.

The packaging machine 1 can additionally be provided with a controller 17. The controller 17 has the function of controlling and monitoring the processes taking place in the packaging machine 1. A display device 19 with operating controls 20 is used for visualizing and influencing by the operator the sequences of processes taking place in the packaging machine 1.

The general mode of operation of the packaging machine 1 is briefly described hereinbelow.

As shown, the film 8 is unwound from the supply roll 7 and conveyed through a forming station 2. In the forming station 2, troughs 11 are formed in the film 8 by thermoforming. The troughs 11 are, together with the surrounding area of the film 8, advanced in a main work cycle to the infeed line (or filling line) 12, where they are filled with a product 13.

Subsequently, the filled troughs 11 are, together with the surrounding area of the film 8, advanced into the sealing station 3 by the feed device in a further work cycle. After having been sealed to the film 8, the cover film 10 is advanced with the feed movement of the film 8. In the course of this process, the cover film 10 can be unwound from the material storage unit 9. By sealing the cover film 10 to the packaging troughs 11, closed packages 15 are obtained, which are still connected to one another in a common composite film 18 at that time. As has already been explained, this composite film 18 is defined by the film 8 and the cover film 10. Finally, the packages 15 are separated from one another by means of the cutting unit 4*a* in the cutting station 4.

In the area of the cutting station 4, outer packages 22 (e.g., paperboard containers) can be provided for accommodating singulated packages 21. FIG. 1 shows a variant in the case of which outer packages 22 are moved by means of a conveyor element (e.g., a conveyor belt 23) to a position below the cutting station 4. When an outer package 22 has been filled completely, it is transported away by means of the conveyor belt 23 and replaced by a new outer package 22.

Figure 2:
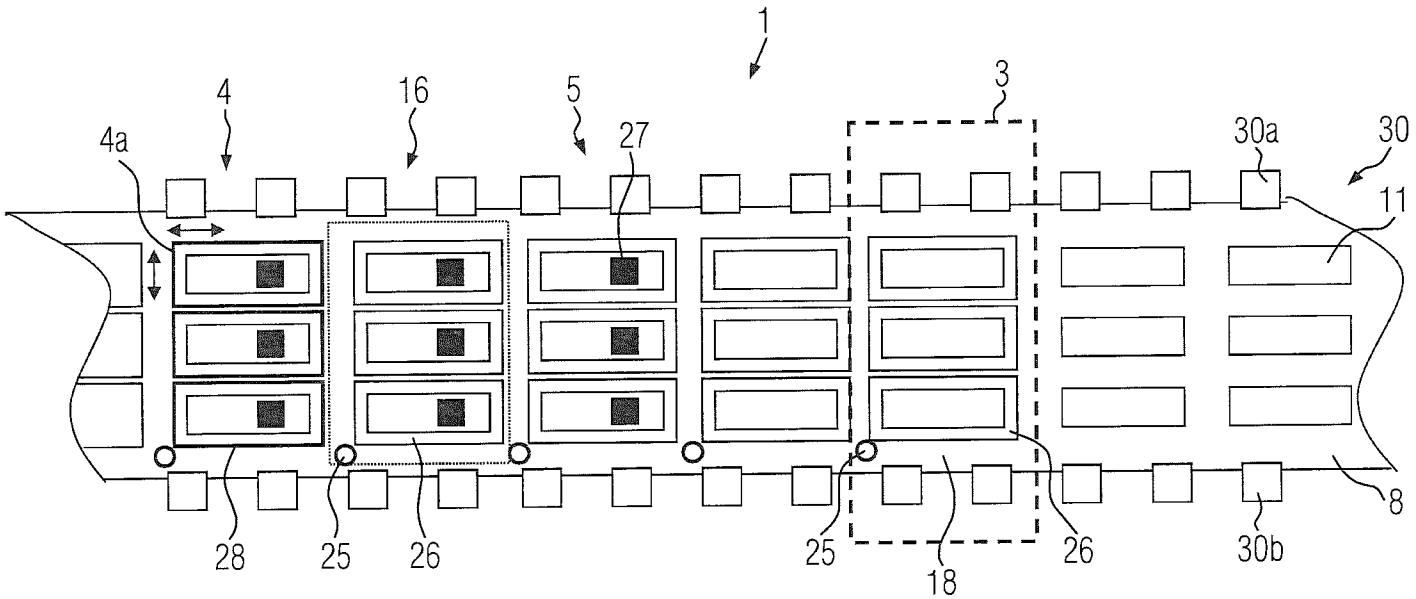
FIG. 2 is a schematic top view of a part of the thermoform packaging machine.

FIG. 2 shows a schematic partial top view of the packaging machine 1 according to one embodiment of the present invention. As illustrated, the film 8 is held on either side by two clamp chains 30*a*, 30*b* defining the feed device 30 and conveyed through the packaging machine 1 in the conveying direction R.

In the sealing station 3, the cover film 10 is sealed onto the film 8 such that sealed seams 26 extending circumferentially around the packaging troughs 11 are formed. These sealed seams 26 hermetically seal the product 13 in the interior of the package 15 thus guaranteeing a long shelf life. The sealing station 3 can additionally incorporate a reference element 25 into the composite film 18. A circular punching knife may, for example, punch an opening 25 as a reference element through both films 8, 10. The reference element 25 thus has a fixed spatial relationship to the sealed seams 26 and the intended cutting pattern 28, respectively.

Subsequently, labels 27 are applied to the packages 15 in the labeling station 5. An identification device 16 (here shown as a vision system) detects, upstream of the cutting station 4, the position of the sealed seams 26 or of one or several reference elements 25. The controller 17 processes the information of the identification device 16 and determines an intended cutting pattern 28 for the cutting unit 4*a*, when the latter is, for example, configured as a laser. The laser is adjusted according to this cutting pattern and its position.

When the cutting station 4 is provided with a combination tool as a cutting unit 4*a*, the controller 17 positions the cutting unit 4*a* in accordance with the position of the reference element 25. The adjustment is effected in the conveying direction R and/or transversely to the conveying direction R (see arrows at position 4 in FIG. 2).

The packages 21 separated from one another in the cutting station 4 are, for example, placed into an outer package 22 or they drop into an outer package 22.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A method for cutting packages out of a composite film in a thermoform packaging machine, said method comprising the steps of:

thermoforming a package in a first film in a thermo-forming packaging machine;

sealing the package with a sealing film in a sealing station to form one or more sealed seams, the one or more sealed seams defining a composite film comprised of the first film and the second film;

producing a reference element in a fixed spatial relation to said sealed seams in said sealing station, wherein the reference element is produced outside an outer contour of the sealed package;

detecting a position of the reference element at a downstream position from the sealing station using an identification device;

orienting a cutting unit based upon the detected position of the reference element; and separating the sealed package from the composite film with the cutting unit by cutting the composite film along the outer contour of the package.

2. The method of claim 1, wherein the orienting the cutting unit step is performed by a controller and includes selectively moving the cutting unit linearly in a conveying direction and/or transversely to the conveying direction based upon the detected position of the reference element.

3. The method of claim 1, wherein producing the reference element step comprises one of punching an opening in at least one of the first film or the sealing film, or forming a seal feature separate from the one or more sealed seams.

4. The method of claim 1, wherein the identification device is a vision system.

5. The method of claim 1, wherein the cutting unit is a laser.

6. The method of claim 1, wherein the cutting unit is a combination tool and is adjusted in accordance with a cutting pattern.

7. A thermoform packaging machine comprising:

a thermoforming station for thermoforming a package in a first film;

a sealing station for sealing the package with a sealing film to create one or more sealed seams to define two or more individual packages, the one or more sealed seams defining a composite film comprising the first film and the sealing film, the sealing station further comprising at least one of a punch or a sealing tool disposed to produce a reference element outside of an outer contour of each of the two or more individual packages and at a known position relative to said one or more sealed seams;

a cutting unit for cutting the composite film to separate the two or more individual packages from one another by cutting along the outer contour of each of the two or more individual packages; and an identification device provided downstream of the sealing station for detecting a position of the reference element;

wherein the cutting unit is disposed for movement in a conveying direction and at least one direction transverse to the conveying direction to orient the cutting unit relative to said one or more sealed seams based upon the detected position of the reference element.

8. The thermoform packaging machine of claim 7, wherein the cutting unit is a combination tool or a laser.

9. The thermoform packaging machine of claim 7, wherein the identification device detects a contour shape of the reference element.

10. The thermoform packaging machine of claim 7, wherein the identification device for detecting the position of the reference element is a vision system.

* * * * *